United States Patent [19]

Ostertag et al.

[11] Patent Number: 4,854,403

[45] Date of Patent: Aug. 8, 1989

[54] STABILIZER FOR DEEP WELL DRILLING TOOLS

[75] Inventors: Alfred Ostertag; Hans Schillinger, both of Celle, Fed. Rep. of Germany

[73] Assignee: Eastman Christensen Company, Salt Lake City, Utah

[21] Appl. No.: 179,273

[22] Filed: Apr. 8, 1988

[30] Foreign Application Priority Data

Apr. 8, 1987 [DE] Fed. Rep. of Germany ..... 3711909

[51] Int. Cl.[4] ..... E21B 7/00; E21B 17/10

[52] U.S. Cl. ..... 175/325; 166/241

[58] Field of Search ..... 175/325, 321, 269, 279, 175/286, 292; 166/241, 212, 217

[56] References Cited

U.S. PATENT DOCUMENTS

| | | | |
|---|---|---|---|
| 3,051,255 | 8/1962 | Deely | 175/325 X |
| 3,123,162 | 3/1964 | Rowley | 175/325 |
| 3,370,657 | 2/1968 | Antle | 166/241 X |
| 4,270,619 | 6/1981 | Base | 175/325 X |
| 4,407,377 | 10/1983 | Russell | 175/325 |
| 4,693,328 | 9/1987 | Furse et al. | 175/325 X |
| 4,776,397 | 10/1988 | Akkerman | 175/325 X |

*Primary Examiner*—Stephen J. Novosad

*Attorney, Agent, or Firm*—Arnold, White & Durkee

[57] ABSTRACT

A stabilizer for deep well drilling tools is disclosed which includes a tubular outer casing having a plurality of slit openings distributed around its periphery with a tubular adjusting mandrel supported in the casing for relative axial movement therewith in response to well fluid pressure applied to the well. A separate elongated ribbed body is movably mounted in each slit opening. Each of the ribbed bodies has a rear wedge face facing opposite to the relative motion of the mandrel which cooperates with a separate mating wedge face on the mandrel such that the ribbed body moves radially outwardly in its respective slit opening upon contact between said mating wedges upon axial movement of the mandrel relative to the casing in response to well fluid pressure applied to the well. Also, each end of each ribbed body has an axially projecting guide projection which terminates in a reduced dimension at its end. Each guide projection has a separate securing piece adapted to be inserted through a slit from outside the casing to hold its guide projection in the casing. Each securing piece has the basic shape of a cylindrical segment and can be inserted into the casing so it is flush therewith. A separate locking pin secures each securing piece in the casing.

18 Claims, 5 Drawing Sheets

Fig. 2
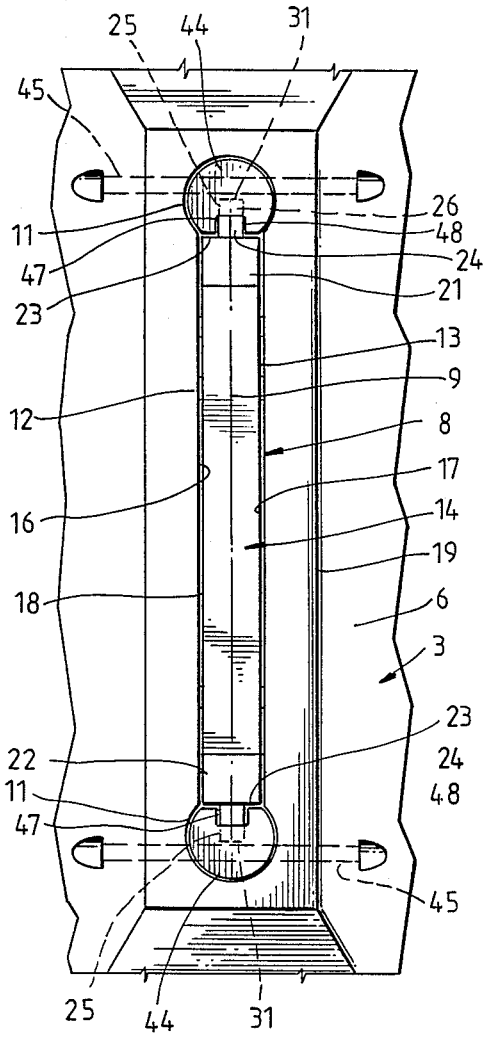
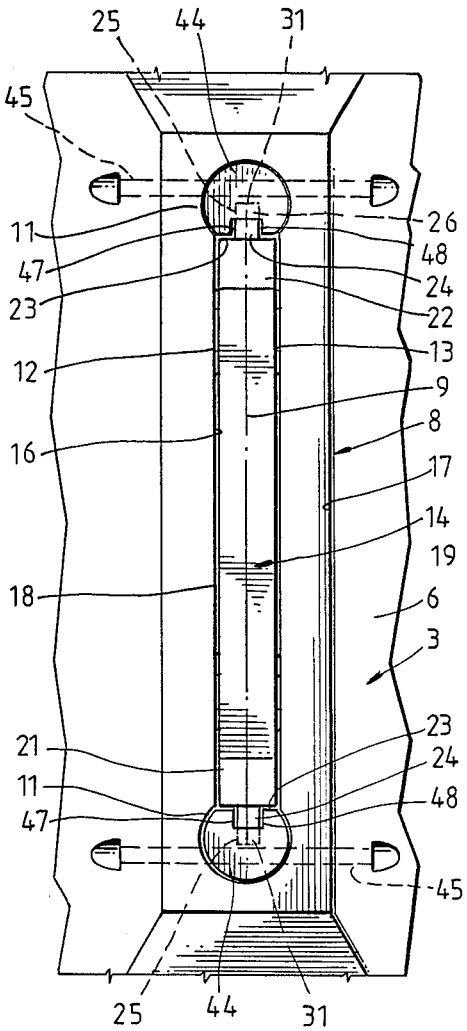
Fig. 5

STABILIZER FOR DEEP WELL DRILLING TOOLS

BACKGROUND OF THE INVENTION

This invention concerns a stabilizer for deep well drilling tools.

With a known stabilizer of this type (U.S. Pat. No. 4,407,377), the ribbed bodies fit tightly in the slit openings of the outer casing and are sealed with respect to the slit openings. The outer longitudinal and end faces of the ribbed bodies thus form guide faces that are in sliding engagement with the inside faces of the slit openings opposite them as mating faces. The ribbed bodies are provided with projections that extend outward along the internal longitudinal edges and act as stops together with the casing to set an outer limit position for the ribbed bodies. The ribbed bodies move radially outward out of a flush starting position in the slit openings into a working position or an outer end position against the force of leaf springs that are braced on the casing and tend to push the ribbed bodies back into their flush starting position. With such a stabilizer, the ribbed bodies have a tendency to stick in the slit openings and fail to return to their starting position because even minor tilting leads to jamming, and furthermore there is the danger that solids such as rock particles in the oil well fluid might stick between the guide faces and block the shifting movements of the ribbed bodies.

SUMMARY OF THE INVENTION

This invention is based on the goal of creating a stabilizer whose ribbed bodies can be moved out reliably into working position even under unfavorable operating conditions and can be retracted into the starting position.

The gap openings between the opposing longitudinal sides of the slit openings and the ribbed bodies create a free space that safely prevents jamming of the ribbed bodies in the slit openings in this area. Nevertheless, the ribbed bodies are guided with sufficient accuracy by the guide projections extending axially at their ends with reduced dimensions, and they are also secured against tilting in the peripheral direction. The ribbed bodies can be inserted easily and rapidly into the outer casing from the outside and are held in position by securing pieces that are also inserted from the outside into the outer casing so they can execute tilting movements when the wedge faces of the adjusting mandrel are lifted away from the rear wedge faces of the ribbed bodies in their longitudinal direction so these tilting movements facilitate shifting of the ribbed body back into their starting position.

BRIEF DESCRIPTION OF THE DRAWINGS

Additional details, versions and advantages derive from the following description and the figures which illustrate several practical examples of the object of this invention in the form of diagrams. The figures show the following:

FIG. 2 shows a cutaway view of the stabilizer in the direction of arrow II—II in FIG. 2.

FIG. 5 shows a cutaway view of the stabilizer in the direction of arrow V in FIG. 4.

DETAILED DESCRIPTION OF PREFERRED EMBODIMENTS

Figure 1:
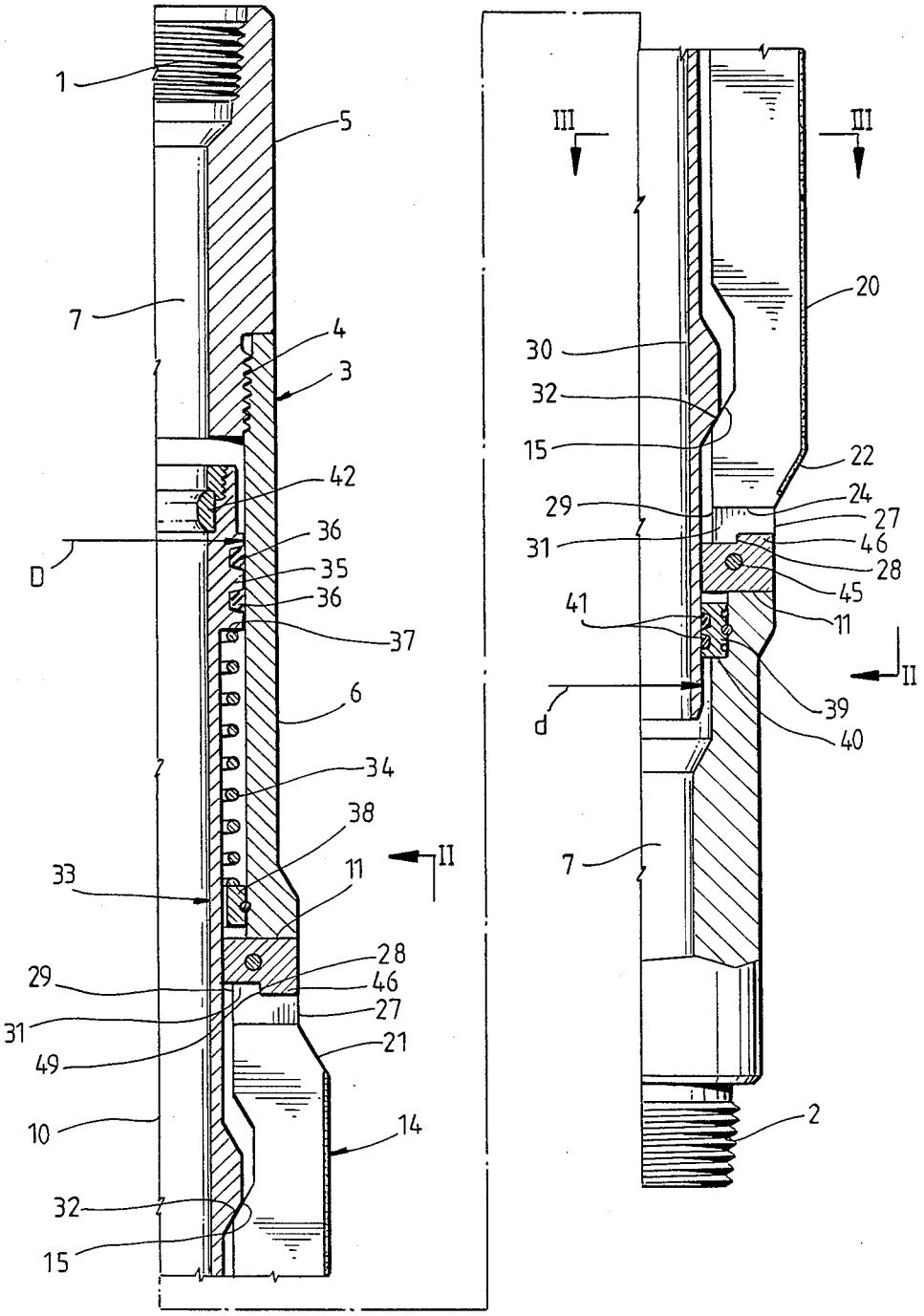
FIG. 1 shows a first version of a stabilizer according to this invention by areas in sectional view or axial section.

The stabilizer for deep well drilling tools illustrated in the figures has a tubular outer casing 3 which has screw thread connections 1, 2 on its ends and in the example shown here consists of two casing parts 5, 6 screwed together at 4. Casing 3 can be inserted and screwed into a drilling shaft and includes a central axially continuous flow channel 7 for a drilling medium which is usually pumped through the drilling shaft to the deep well drilling tool, e.g., a rotary drill bit positioned centrally or eccentrically with the axis of the drill casing.

Casing 3 has slit openings 8 distributed around the periphery, but only one is illustrated in each case here. Casing 3 has at least two diametrically opposed slit openings 8 but may also have three or four slit openings 8 which form a group at one level. Furthermore, the stabilizer may also have groups of slit openings 8 positioned axially at some distance apart and in turn formed by at least two slit openings.

With the stabilizer versions shown here, slit openings 8 extend axially and have a linear main axis 9. Instead of this the slit openings may also run at an acute angle to the longitudinal middle axis 10 of casing 3 and regardless of their alignment, instead of having a straight design they may also have a curved or helical shape of the main axis 9.

With the stabilizer versions according to FIGS. 1 to 5, the slit openings 8 end in an enlargement 11 which is bordered by an arc whose diameter somewhat exceeds the distance between the longitudinal sides 12, 13 of slit opening 8. Slit openings 8 together with enlargements 11 are located in the area of housing elevations 3' on the outside, increasing the holding space and at the same time forming reinforcements for housing 3.

There is an elongated ribbed body 14 in each slit opening 8, and in the versions shown according to FIGS. 1 to 5, the ribbed body is in the form of a straight rod that has a rear wedge face 15 near each end. FIGS. 1 to 5 show the ribbed bodies in the extended working end position (**14*a* in FIG. 3) from which they can be returned into a starting position flush with casing 3 (14*b* in FIG. 3**).

Longitudinal sides 16, 17 of ribbed body 14, that are parallel to each other and to the longitudinal sides 12, 13 of slit openings 8, are a distance apart which is somewhat smaller than the distance between the longitudinal sides 12, 13 of slit openings 8. Therefore, gap openings 18, 19 remain between longitudinal sides 12, 16 and 13, 17, and these gap openings 18, 19 have a width that assures that ribbed bodies 14 cannot become stuck in slit openings 8 either due to direct jamming action between longitudinal sides 12, 16 and 13, 17 of the parts or due to deposition of solid particles from the oil well fluid between the parts. The width of gap openings 18, 19 can accordingly reach the millimeter size range depending on the diameter of casing 3 and the other dimensions of slit openings 8 and ribbed body 14, which in turn depend on the diameter of casing 3, and when the casing diameter is 120.65 mm, for example, the width of the gap opening may be about 3 mm.

Ribbed bodies 14 have a coating 20 of an especially wear-resistant material such as sintered metal on their outer surface and at their ends they have a taper 20, 22 that reduces the radial dimensions toward the ends and they also have axially projecting guide projections 24 over their end faces 23. These guide projections 24 have a width measured in the circumferential direction of casing 3 such that the width is smaller than the width of the ribbed bodies 14, e.g., is reduced by one-half. The guide projections 24 that are symmetrical with the longitudinal midplane of each ribbed body 14 have parallel side guide faces 25, 26, a front side 27, 28 that is graduated in height and faces outward and a rear side 29 that is flush with the rear side 30 of ribbed body 14. In the area beneath part 28 of the front side, guide projections 24 have a height which when measured in radial direction corresponds approximately to half the height of the guide projections 24 in the area below part 27 of the front side. In this way, guide projections 24 have an outer part 31 which in addition to a guide function also fulfills the function of a stop lug as described in greater detail below.

The rear wedge faces 15 near the ends of ribbed body 14 are opposite mating wedge faces 32 which are on the outside of the tubular adjusting mandrel 33, e.g., on rotating elevations. Adjusting mandrel 33 is designed as the differential pressure piston exposed to the oil well fluid and having a larger piston area at the top, in the version according to FIG. 1, and a smaller piston area at the bottom and is under pretension from a restoring spring 34 that tries to press the adjusting mandrel 33 into an upper starting position.

Specifically, adjusting mandrel 33 has a ring-shaped outer piston extension 35 on its upper end which is in sliding engagement with the inside face of part 6 of casing 3 and is sealed by means of gaskets 36 with respect to this inside face. Piston projection 35 forms a lower shoulder 37 on which restoring spring 34 (which is designed as a helical spring), rests with its upper end. The lower end of restoring spring 34 is braced on a supporting ring 38 which is secured on the inside of part 6 of casing 3 at a suitable distance below piston extension 35.

In the area of its lower end, adjusting mandrel 33 is guided by a guide ring 39 which rests on a shoulder 40 on part 6 of casing 3, is secured on it and has gaskets 41 to seal it with respect to the outer face of adjusting mandrel 33.

The hydrostatic pressure acting on the differential area between two gasket diameters, "D" and "d," exerts a downward adjusting force on adjusting mandrel 33 which counteracts the upward restoring force of restoring spring 34. When the downward adjusting force exceeds the restoring force of restoring spring 34 depending on the pressure in the oil well fluid in flow channel 7, adjusting mandrel 33 is moved downward so ribbed bodies 14 execute a parallel outward movement over wedge faces 32 and wedge faces 15 until they reach an outer working end position.

If the restoring force exceeds the adjusting force, the adjusting mandrel 33 moves upward so the wedge faces 32 come out of pressure contact or adjusting engagement with wedge faces 15 of ribbed bodies 14 which are then free to return to their flush starting position in casing 3.

The return of ribbed bodies 14 to their starting position takes place in the versions according to FIGS. 1 to 5 with upward or downward movements of the stabilizer in the borehole in interaction with the borehole wall as soon as the taper 21 or 22 comes into engaged position with the borehole wall and causes the upper or lower end of the ribbed body to snap into position before a greatly facilitated inward shifting of the ribbed bodies 14 along their entire length through the borehole wall is then induced.

The desired conditions can be established above ground by varying the delivery pressure of the oil well fluid pump. In addition, a difference between the pressure with which the oil well fluid acts on the upper piston area of the adjusting body 33 in FIG. 1 and the pressure in the oil well fluid acting on the lower piston area of the adjusting body 33 can be created by means of a nozzle ring body 42 mounted interchangeably on the upper edge of the adjusting body 33. This increases the adjusting force regardless of the diameter ratio D/d.

The ribbed bodies 14 are held in their slit openings 8 in casing 3 by securing pieces 44 that can be inserted into the casing from the outside and have the basic shape of the cylindrical segment in the stabilizer versions according to FIGS. 1 to 5. These securing pieces 44 are countersunk in the enlargements 11 at the ends of slit openings 8 and are fixed in their installed position by tangential locking pins 45. Securing pieces 44 reach over guide projections 24 but only into the area of the outside parts 31 in the versions according to FIGS. 1 to 5. To this end each securing piece 44 is provided with a recess 46 that is gradated in longitudinal section and is fitted to the corresponding shape of guide projections 24 with outside part 31 and presents side guide mating faces 47, 48 that work together with guide faces 25, 26 of a guide projection 24 and forms a shoulder 49 which extends over the outside part 31 of guide projection 24. This shoulder 49 forms a stop for part 28 of front side 27, 28 of guide projection 24 by which the working end position of ribbed bodies 14 is defined.

Such a design for guiding and securing ribbed bodies 14 in their slit openings 8 permits a simple and rapid method of assembling ribbed bodies 14 from the outside of casing 3, it secures a sufficiently precise guidance of ribbed bodies 14 in their extension and retraction and furthermore secures ribbed bodies 14 adequately against tilting due to forces acting in the peripheral direction of casing 3 on ribbed bodies 14 during operation of the stabilizer. The guide engagement faces are so small that jamming effects that occur in their area due to deposits of solid particles from the oil well fluid, for example, can only be of such a small extent that they cannot block the inward and outward movements of ribbed bodies 14.

Figure 3:
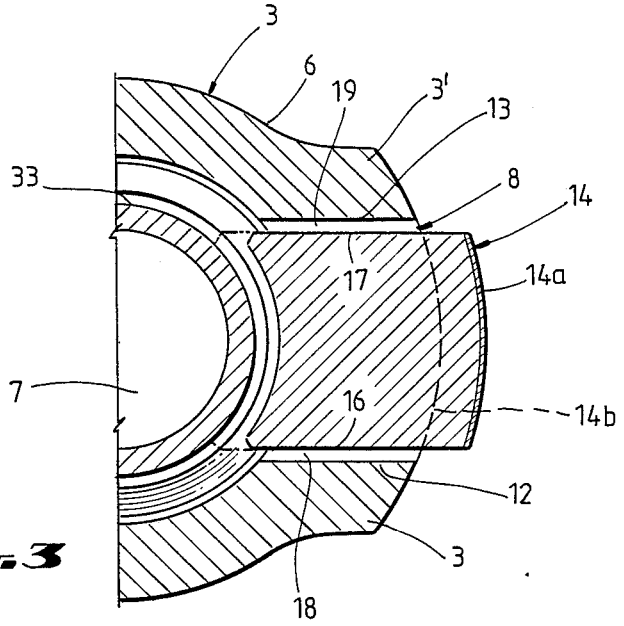
FIG. 3 shows a section according to line III—III in FIG. 1.
Figure 4:
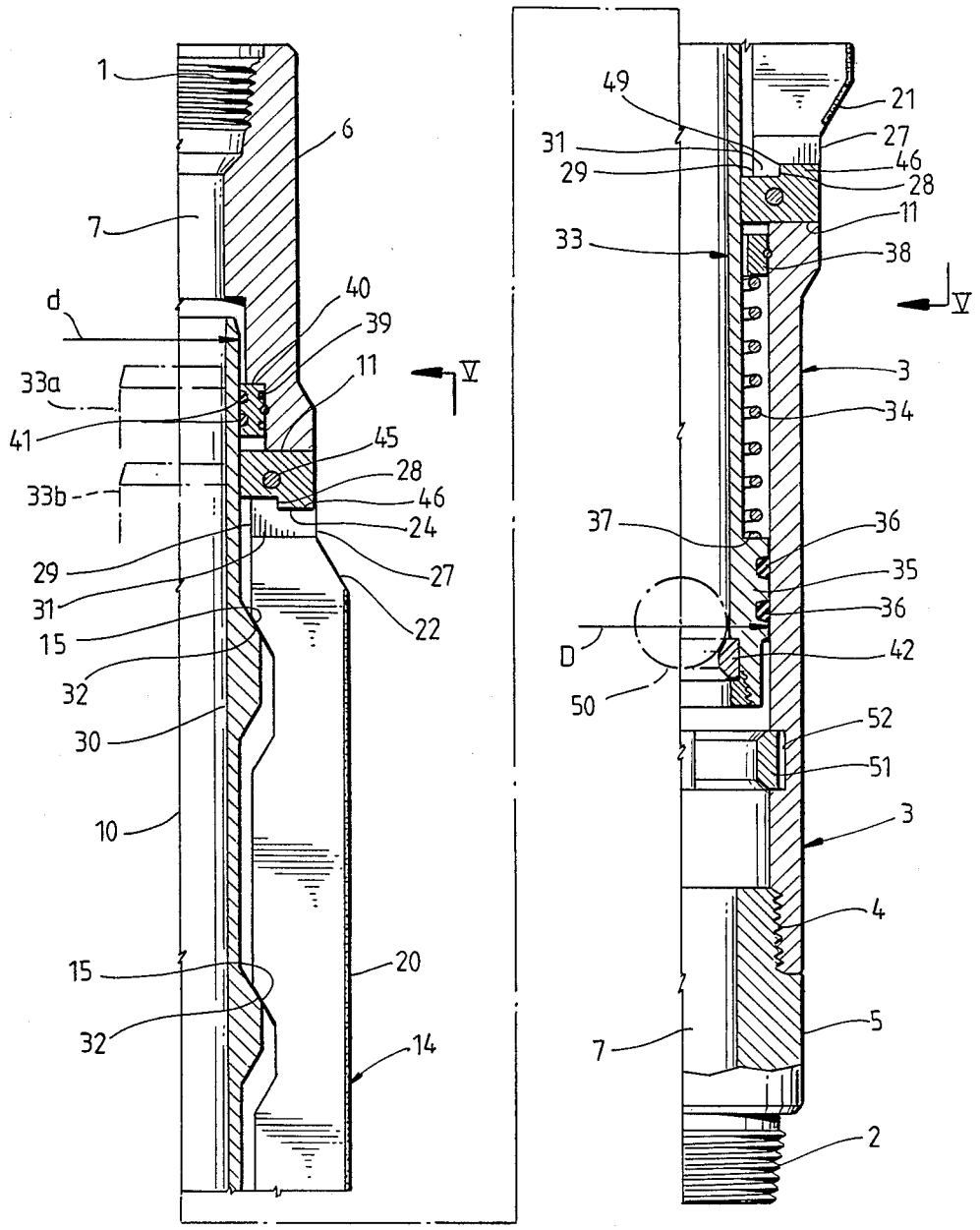
FIG. 4 shows a second version of the stabilizer according to this invention in a diagram like that in FIG. 1.

In the design of slit openings 8, ribbed bodies 14 and securing pieces 44, the stabilizer version according to FIGS. 4 and 5 corresponds essentially to that according to FIGS. 1 to 3. This is also true of casing 3 and adjusting mandrel 33 but with the difference that the casing and adjusting body have an installed position that is tilted by 180., i.e., it is stood on its head, with the result that the upper screw thread connection 1 is on part 6 of casing 3 and the lower screw thread connection 2 is on part 5 of casing 3. The reference numbers from FIGS. 1 to 3 have therefore also been used for corresponding parts with no change in FIGS. 4 and 5.

Functionally, the inverted fitting position (on its head) has the effect that the hydraulic adjusting force for adjusting mandrel 33 is directed upward and the restoring force of restoring spring 34 is directed downward. Therefore, lowering the pressure of the oil well fluid causes adjusting mandrel 33 to move downward as soon as the restoring force exceeds the adjusting force and thus the ribbed bodies 14 are released for an inward movement.

Nozzle ring 42 on the lower end of adjusting mandrel 33 in the version according to FIG. 4 not only fulfills the function of reducing the adjusting force derived from the oil well fluid pressure for adjusting mandrel 33 but also fulfills the special function of forming a valve seat for an insertion valve body designed as a valve ball 50.

If after reducing the pressure of the oil well fluid the restoring force has moved adjusting mandrel 33 into the release position, indicated by 33*a*, where the ribbed bodies 14 can move back into their starting position in casing 3 due to inward directed forces acting on them, and if a valve body 50 is then inserted, a strong downward force is exerted by the oil well fluid on the adjusting mandrel in addition to the restoring force due to the fact that flow channel 7 is blocked at the lower end, and this downward force causes adjusting mandrel 33 to move into the lower end position illustrated by 33*b*. In this end position, the oil well fluid is forced to flow out of flow channel 7 at the upper end of adjusting mandrel 33 and past gasket 39 through slit openings 8 with the result that the oil well fluid flushes out any solid particles that might be deposited in the gap openings 18, 19.

With such a downward movement induced by valve body 50, the lower end of adjusting mandrel 33 comes into engagement with a stop element which in the practical example according to FIG. 4 is also designed as a fixing element, namely as a slotted radially expandable fixing ring which rests in an internal groove 52 in part 6 of casing 3. This stop and fixing element which may also have any other suitable design defines the lower end position for adjusting mandrel 33 and also secures it when the pumping of oil well fluid is concluded so the oil well fluid present in the drilling shaft above valve body 50 can escape into the borehole for the sake of drainage when the drilling shaft is pulled up. For the next operation of the deep well drilling tool, valve body 50 is removed from the stabilizer and the adjusting mandrel 33 is pushed up out of engagement with the stop and fixing ring 51, which can be accomplished, for example, as part of an above-ground maintenance job by a tool inserted from beneath after unscrewing casing part 5.

Figure 7:
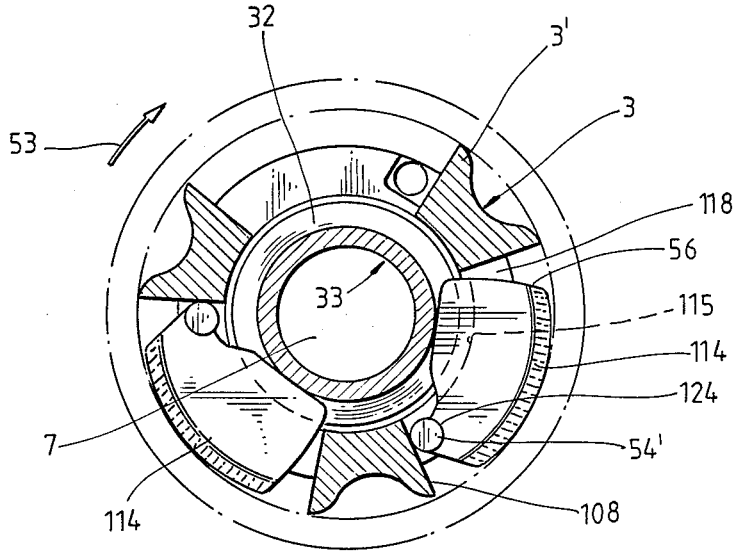
FIG. 7 shows a schematic sectional view according to line VII—VII in FIG. 6.
Figure 6:
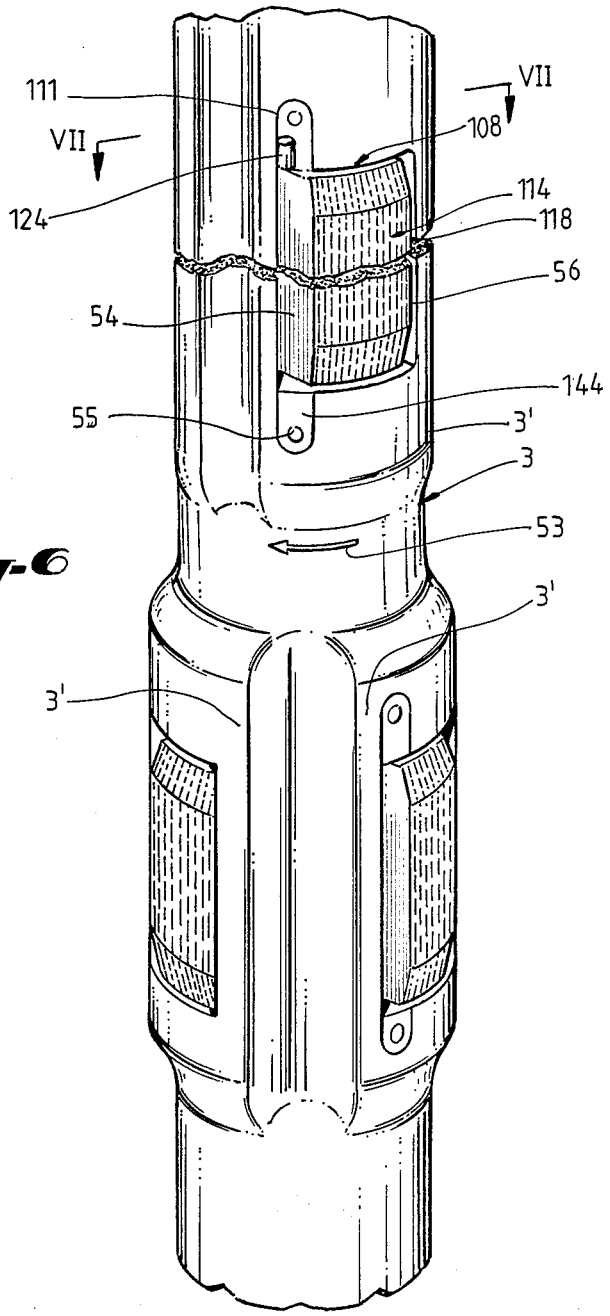
FIG. 6 shows a cutaway perspective view of a third version of the stabilizer according to this invention.

Finally, FIGS. 6 and 7 show in diagram form a third stabilizer design whereby the ribbed bodies 114 are designed as swing wings that can pivot about axial (at least essentially axial) articulated axles 54' at the forward edge in the direction of rotation 53. Guide stops 124 here are designed as pivot pins located near the front edge 54 of ribbed bodies 114 as seen in the direction of rotation 53 of casing 3 in operation and they project upward and downward beyond their contour. To receive these pivot pins 124, slit opening 108 where ribbed body 114 is illustrated here in the fully inserted flush starting position is provided with axial enlargements 111 that are cup shaped and are located in the area of the front corners as seen in the direction of rotation 53 in operation. Securing pieces 144 are designed as mold caps that can be inserted into the enlargements 111, secured there by means of bolts 55 and hold pivot pins 124 in position in enlargements 111 extending over them.

Since ribbed bodies 114 execute inward and outward movements to shift them out of the flush starting position into their operating position, ribbed bodies 114 are provided with wedge faces 115 on their rear side or inside only near their edge 56 that is to the rear in the direction of rotation 53 of casing 3 in operation, and these wedge faces essentially correspond to wedge faces 15 in the versions according to FIGS. 1 to 5 and work together with mating faces 32 on an adjusting mandrel which may have a design like that of adjusting mandrel 33 in the version according to FIGS. 4 and 5. Moreover, a gap opening 118 is left between slit opening 108 and ribbed body 114, preferably extending around the entire ribbed body 114.

What is claimed is:

1. A stabilizer for deep well drilling tools, comprising:

a tubular outer casing insertable into a drilling shaft and defining a plurality of slit openings distributed around its periphery;

a tubular adjusting mandrel supported in the casing in axially movable relation with the casing in response to well fluid pressure applied to the well;

a separate elongated ribbed body movably fitted in each slit opening, said ribbed body having a rear wedge face facing opposite to said relative motion of said mandrel;

said mandrel having a separate mating wedge face for the rear wedge of each said ribbed body;

each said ribbed body capable of outward movement in its respective slit opening in response to contact between said mating wedges upon said axial movement of said mandrel relative to said casing responsive to said fluid pressure;

each said ribbed body and its respective slit opening configured to define gaps between the longitudinal sides thereof;

an axially projecting guide projection at each end of said ribbed body terminating in a reduced dimension at its end and having parallel side guide faces; and, a separate securing piece for each guide projection adapted to be inserted through a slit from outside the casing and configured to reach over its respective guide projection and to fit between its guide projection and the casing to hold its guide projection in the casing.

2. Stabilizer according to claim 1, in which the securing pieces have parallel inner guide faces which are opposite the parallel side guide faces on the guide projections.

3. Stabilizer according to claim 1, in which each guide projection has a front side that faces outward and is graduated in height, and each securing piece has a stop face positioned to come to rest against the front face of its respective guide projection.

4. Stabilizer according to claim 3, in which the stop faces of the securing pieces and the front sides of the guide projections overlap each other only in the area of an outside part of the guide projections.

5. Stabilizer according to claim 1, in which the guide projections have a width corresponding approximately to half the width of a ribbed body and run symmetrically with the longitudinal midplane of their ribbed body.

6. Stabilizer according to claim 1, in which each guide projection has a height corresponding approximately to half the height of the ribbed body in the outer part that reaches below its respective securing piece and has a rear side that falls flush with the rear side of the ribbed body.

7. Stabilizer according to claim 1, in which each securing piece has the basic shape of a cylindrical segment and can be inserted into casing so it is flush with the casing.

8. Stabilizer according to claim 1, which further comprises a separate locking pin adapted to secure each securing piece in the casing.

9. Stabilizer according to claim 1, in which the guide projections of each ribbed body form pivot pins which are located near the front edge of the ribbed body that is at the front in the direction of rotation of the casing in operation to enable the ribbed bodies to act as swing wings.

10. Stabilizer according to claim 9, in which the ends of the slit openings are enlarged and the securing pieces are molded caps adapted to fit tightly in a flush position in the enlargements.

11. Stabilizer according to claim 9 or 10, in which each ribbed body is flush with a wedge face at the rear near its rear edge in the direction of rotation of the casing in operation, whereby said wedge face transmit a pivoting moment to the ribbed body when mated with a wedge face of the adjusting mandrel.

12. Stabilizer according to claim 1, in which the adjusting mandrel is a differential pressure piston capable of being acted on by the oil well fluid and has a larger piston area at the top and a smaller piston area at the bottom and is under the pretension of a restoring spring that attempts to press the adjusting mandrel into an upper release position.

13. Stabilizer according to claim 12, which further comprises an exchangeable nozzle ring body supported in the area of the upper end of the adjusting mandrel.

14. Stabilizer according to claim 1, in which the adjusting mandrel comprises a differential pressure piston capable of being acted on by oil well fluid and having a larger piston area at the bottom and a smaller piston area at the top and is under the pretension of a restoring spring biased to press the adjusting mandrel into a lower release position.

15. Stabilizer according to claim 14, which further comprises an exchangeable nozzle ring body supported by the adjusting mandrel in the area of its lower end.

16. Stabilizer according to claim 14 or 15, wherein the adjusting mandrel includes a valve seat ring at its upper end for a valve body consisting of an insertion valve ball.

17. Stabilizer according to claim 14, which further comprises a stop element provided below the lower end of the adjusting mandrel in release position, said stop defining the lower end position for the adjusting mandrel moved downward beyond its release position.

18. Stabilizer according to claim 17, wherein the stop element comprises a radially expandable fixing ring secured in the casing.

* * * * *